US008250690B2

(12) United States Patent
Jurmann et al.

(10) Patent No.: US 8,250,690 B2
(45) Date of Patent: Aug. 28, 2012

(54) MACHINE FOR WASHING AND/OR DRYING LAUNDRY

(75) Inventors: Rainer Jurmann, Falkensee (DE); Harald Moschütz, Groβbeeren (DE); Uwe Ratfisch, Berlin (DE); Mark Sauer, Bergfelde (DE); Horst Wiemer, Kleinmachnow (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 950 days.

(21) Appl. No.: 12/226,171

(22) PCT Filed: Apr. 13, 2006

(86) PCT No.: PCT/EP2006/061570

§ 371 (c)(1),
(2), (4) Date: Oct. 8, 2008

(87) PCT Pub. No.: WO2007/118512

PCT Pub. Date: Oct. 25, 2007

(65) Prior Publication Data

US 2010/0251778 A1 Oct. 7, 2010

(51) Int. Cl.
*D06F 33/02* (2006.01)

(52) U.S. Cl. ..... 8/158; 68/12.06; 68/12.27; 68/23.1

(58) Field of Classification Search ..... 68/12.06, 68/12.27, 23.1, 140
See application file for complete search history.

(56) References Cited

U.S. PATENT DOCUMENTS

| | | | | |
|---|---|---|---|---|
| 6,813,524 | B2 * | 11/2004 | Peterson et al. | 700/13 |
| 6,813,911 | B2 * | 11/2004 | Peterson et al. | 68/12.27 |
| 7,263,904 | B2 * | 9/2007 | Yoshida et al. | 73/862.331 |
| 2003/0024280 | A1 * | 2/2003 | Peterson | 68/12.01 |
| 2003/0024281 | A1 * | 2/2003 | Peterson et al. | 68/12.27 |
| 2004/0083774 | A1 | 5/2004 | Kinouchi et al. | |
| 2006/0010936 | A1 | 1/2006 | Weinmann et al. | |
| 2007/0022809 | A1 * | 2/2007 | Yoshida et al. | 73/200 |
| 2007/0113598 | A1 * | 5/2007 | Jun et al. | 68/140 |

FOREIGN PATENT DOCUMENTS

| | | | |
|---|---|---|---|
| DE | 198 04 080 | | 8/1999 |
| EP | 0 856 604 | | 8/1998 |
| EP | 1 154 064 | | 11/2001 |
| WO | WO 2004102146 | A1 * | 11/2004 |
| WO | WO 2005/059492 | | 6/2005 |

OTHER PUBLICATIONS

International Search Report PCT/EP2006/061570.

* cited by examiner

*Primary Examiner* — Joseph L Perrin
(74) *Attorney, Agent, or Firm* — James E. Howard; Andre Pallapies

(57) ABSTRACT

A machine for laundry has a drum shaft rotatably mounted by a bearing for driving a laundry drum and having a device for determining loading-relevant characteristic variables or an unbalance of the laundry drum or of the drum shaft. The device for determining loading-relevant characteristic variables or an unbalance includes a magnetic field sensor that senses a magnetized region on the drum shaft or the laundry drum.

18 Claims, 1 Drawing Sheet

MACHINE FOR WASHING AND/OR DRYING LAUNDRY

BACKGROUND OF THE INVENTION

The invention relates to a machine for washing and/or drying laundry that operates particularly on the front-loading principle, and to a method for determining and processing loading-relevant characteristic variables or, as the case may be, imbalance parameters of a laundry drum or drum shaft of the machine of the type indicated in the present invention.

A problem that arises while washing machines are operating is due to the vibrations occurring particularly during the spin phase. They result from the imbalance due to the laundry's uneven mass distribution in the laundry drum. Said imbalance may already exist from the time the washing process starts, but it can also first develop during a spin operation owing to different draining properties of the laundry and change over time as the process continues. Allowance will be made for the imbalance-induced forces by appropriately suspending the washing unit with the washing drum. The washing unit's suspension can still be overstrained, though, should a large imbalance occur at high revolution rates, which can cause the machine to what is termed walk or kick. But even when the machine is operating within tolerable vibration-induced excursion limits the imbalance-induced forces will lead not only to the development of undesired noise but also to greater wear-and-tear in the washing machine, particularly in its moving parts and bearings. Optimized washing-process controlling must hence be directed toward as comprehensive as possible determining of loading-relevant characteristic variables or, as the case may be, imbalance parameters and the evaluating thereof for effectively limiting and/or totally avoiding the imbalance due to the distribution of the laundry's mass.

Described as known in DE 100 22 609 C2 are a method for limiting the imbalance effect of a washing unit of a washing machine and a device for implementing said method. A plurality of sensors are therein attached in a distributed manner to the perimeter of a suds container of the washing machine for determining an imbalance occurring during the washing process due to a moving laundry drum. Said sensors register the imbalance-induced excursions of the suds container as well as the phase shifts between them. Measures to limit the imbalance will be initiated depending on the excursion values registered. Acceleration sensors or optical and/or electromechanical travel sensors can therein be employed as sensors.

What is to be seen as disadvantageous about that method and device is the fact that only the dynamic, already acting imbalance produced by the laundry's unbalanced loading can be detected by the sensors arranged on the suds container and, moreover, that not all parameters of relevance for effectively limiting said imbalance, such as, for instance, the total weight of the laundry in the washing drum, can be registered. What is further to be seen as disadvantageous is that on the one hand increased manufacturing costs will arise owing to the need for a plurality of sensors for implementing the method and that, on the other hand, attaching them to the perimeter of the suds container will impose structural-design limitations on the components also arranged in that region.

BRIEF SUMMARY OF THE INVENTION

The object of the present invention is therefore to provide a machine and a method of the kinds cited in the introduction by means of which a greater number of relevant parameters will be accessible for more efficiently limiting imbalance-induced effects and by means of which a more compact, more flexible, and less expensive machine construction will be made possible.

Said object is inventively achieved by means of a machine for washing and/or drying laundry and of a method for determining and processing loading-relevant characteristic variables or, as the case may be, imbalance parameters of the laundry drum or, as the case may be, drum shaft of the machine having the features of the present invention.

Advantageous embodiments displaying expedient and non-trivial developments of the invention are described in the other claims.

The inventive machine is in particular a washing machine that operates on the front-loading principle, by which is meant a washing machine having a laundry drum that is mounted rotatably around a horizontal axis or one slightly inclined relative to a horizontal axis and which can be loaded with laundry from the front. Conceivable also, though, would be tumble driers or any other machines for treating items of clothing in the case of which there is the possibility of an imbalance effect due to uneven loading particularly during spin phases. The invention therefore relates not only to washing machines that operate on the front-loading principle but to any machines embodied having a drum shaft for driving a laundry drum for washing and/or drying laundry, meaning, for instance, also to washing machines operating on the top-loading principle that have a laundry drum requiring to be filled from above as well as to dry-cleaning machines.

The machine for determining and processing loading-relevant characteristic variables or, as the case may be, an imbalance inventively includes at least one magnetic-field sensor unit by means of which the magnetic field of a magnetized region moved with the drum shaft or, as the case may be, laundry drum is to be detected. Said magnetic-field sensor unit has, for example, a plurality of magnetic-field sensors so that, for instance, the drum shaft's axle position can also be determined contactlessly alongside parameters correlating with forces and moments. Inter alia a sensor operating on the Hall principle is therein suitable as a sensor type. In other words it will be possible to determine the relevant characteristic loading variables directly in the vibrating system and not only their effect in the form of, for example, variations in the washing drum's rotation rate. It will furthermore not be necessary to make the washing drum rotate to be able to determine imbalance-related parameters by way of the excursions not occurring until while it is rotating. Because the forces and moments that occur are inventively determined contactlessly on the drum shaft, the parameters of relevance for treating an existing imbalance can directly and with no wear-and-tear be measured on the most directly loaded component. The magnetostrictive property of the magnetizable materials preferably employed is furthermore also an immanent property free from wear-and-tear.

For the inventive machine's structural design it is necessary only for a sensor unit having low space requirements to be arranged preferably in the easily accessible region of the drum shaft so that a more compact and less expensive machine construction will be realizable.

A particularly simple embodiment of the magnetized region co-moved with the drum shaft can be provided by fabricating the in any event present drum shaft itself at least in sections from a material having magnetic properties. All parameters of relevance for treating an imbalance of the laundry drum can therein be registered directly on the drum shaft because both the forces and moments produced in the region of the washing drum by the laundry on the one hand and, on the other, the forces and moments produced by the drive unit act directly upon the drum shaft.

It has alternatively proved particularly advantageous to link drum shafts themselves possessing no or only insufficient magnetic properties to a co-moved component for example frictionally and/or in a form-fit manner in the form of, for example, a shell arranged around the outer circumference. The magnetized region co-moved with the drum shaft can thereby be provided extremely simply by the co-moved component. For machines already developed it would furthermore be conceivable thereby to provide a solution by means of which the inventive advantages can be realized retroactively. Using an additional magnetizable component will furthermore allow the drum shaft to be made of a material that can be selected independently of its magnetic properties. The magnetic region needed for realizing the invention can, moreover, in a cost-reducing manner be limited to an absolutely necessary minimum.

If ferromagnetic materials having an as high as possible magnetostriction constant—such as, for example, steel No. 1.4057 having the short name X17CrNi16-2—are used for realizing the magnetic region, then the forces and moments occurring in and on the drum shaft or, as the case may be, the component linked thereto can particularly advantageously be transformed by the effect of the inverse magnetostriction into correspondingly large, easily detectable changes in the magnetic field formed by the material. That will allow less expensive magnetic-field sensor units to be employed that exhibit less sensitivity.

A structurally particularly practical and compact arrangement will ensue if the magnetic-field sensor unit is embodied within the bearing arrangement in such a way as to be located in the central region between two bearings forming the drum shaft's rotationally movable bearing. That is practical in respect also of the drum shaft's maximum bowing between the bearings that occurs, for example, when the washing drum is stationary owing to the laundry's gravity effect on the one hand and the drive unit's pulling effect on the other, and, when the washing drum is revolving, owing to the centrifugal force of the circulating imbalance due to the laundry.

If the magnetic-field sensor unit is connected to a control device of the washing machine, the possibility will advantageously ensue of evaluating the parameters determined by the sensor unit and selectively intervening in the wash program's cycle so that the imbalance-induced effect having occurred can be situation-dependently minimized or even proactively totally prevented.

In a further advantageous embodiment the dynamic parameter values arising on the drum shaft are determined by the magnetic-field sensor unit. Said parameter values include firstly various torques such as that produced by the drive unit's driving torque, that due to uneven mass distribution inside the laundry drum, as well as those due to friction within the bearing arrangement and friction between the washing drum and the air or, as the case may be, suds etc. surrounding it. Said parameter values further include a torsional moment that develops within the drive shaft owing to the interaction between the drive torque at one end of the drum shaft and the torque arising at the other end owing to the loaded laundry drum's mass inertia. A further parameter value can be a bending moment of the drum shaft due to the imbalance-induced centrifugal force, which moment as seen from the outside circulates with the drum shaft. What, finally, is especially advantageous is the arrangement in the magnetic-field sensor unit of a further magnetic-field sensor that determines the drum shaft's momentary axle position through measuring a permanently magnetized region linked to the drum shaft and thereby enables the washing drum's angular velocity and/or momentary angle of rotation to be determined precisely.

A further major parameter value for specifically targeted imbalance treatment is the total weight of the laundry placed into the washing drum. Said weight can be inventively determined by directly determining the flexural force being statically applied to the drum shaft, because said force is made up only of values that are system-dependent and can be assumed to be constant and the variable weight force of the laundry. Said parameter is proportional to the weight of the laundry and independent of the position of the laundry drum's rotational angle. It is therefore particularly suitable for determining the weight of the laundry. It is herein to be noted that the weight of the laundry is subject to changes over time during the washing process due to different degrees of dampness.

It is provided in the inventive method for initially determining the loading-relevant characteristic variables or, as the case may be, imbalance parameters on the drum shaft or, as the case may be, laundry drum via the magnetic-field sensor unit and as a function of said parameters deriving corresponding control and/or regulating parameters for the momentary washing process. Advantageous embodiments of the inventive device are to be regarded as advantageous embodiments of the inventive method.

In a particularly advantageous embodiment of the inventive method the bending moments, torques, and/or torsional moments occurring on the drum shaft as well as its momentary angle of rotation or, as the case may be, momentary angular velocity are determined in the dynamic process condition. It is thereby made possible to precisely determine the position of the mass distribution causing the imbalance inside the laundry drum. The flexural force that is acting momentarily upon the drum shaft and via which the weight of the laundry placed into the washing drum can be determined is preferably determined in the static process condition.

The force, moment, and/or angular-velocity values that have been determined can in a preferred manner be evaluated by the machine's control device. Said evaluating will allow control and regulating parameters to be derived straight away and hence selective interventions to be made in the washing process for limiting and/or proactively avoiding the imbalance-induced effect.

For the method it is furthermore advantageously provided for selectively varying the laundry drum's momentary rotational speed and/or angular velocity by means of the control and regulating parameters that have been derived, as a result of which on the one hand limiting of the imbalance-induced forces acting upon the washing unit will be achieved and, on the other, the possibility will be provided of largely or totally eliminating the imbalance by selectively distributing the laundry unevenly distributed in the washing drum.

BRIEF DESCRIPTION OF THE DRAWINGS

Further advantages, features, and specifics of the invention will emerge from the following description of a preferred exemplary embodiment and with the aid of the drawings, in which.

DETAILED DESCRIPTION OF THE PRESENT INVENTION

Figure 1:
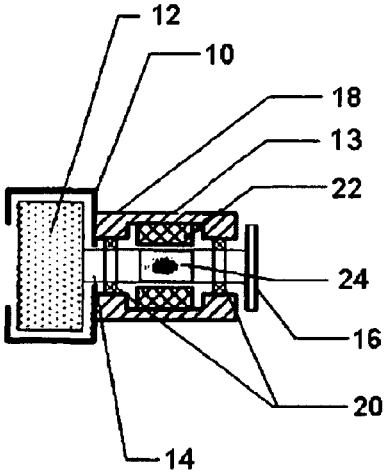
FIG. 1 shows a schematic sectional view through a machine, embodied as a front-loading washing machine for washing and/or drying laundry, having a laundry drum driven via a drum shaft and having a magnetic-field sensor unit, arranged in the region of a bearing arrangement of the drum shaft, for determining loading-relevant characteristic variables or, as the case may be, an imbalance of the laundry drum or, as the case may be, drum shaft.

From a machine, embodied in the present exemplary embodiment as a front-loading washing machine, for washing and/or drying laundry FIG. 1 shows in a schematic sectional view a suds container 10 that is arranged inside a washing-machine housing (not shown) and in which a laundry drum 12 is arranged supported unilaterally via a bearing arrangement 13. The laundry drum 12 is joined via a drum shaft 14 to a belt pulley 16 that transfers a drive unit's torque to the drum shaft 14 of the laundry drum 12 via a driving belt (not shown). The drum shaft 14 is therein held in position by two bearings 20 of the bearing arrangement 13 which are in turn accommodated spaced apart inside a bearing housing 18. The bearings 20 are in the present exemplary embodiment embodied as ball bearings. The bearing housing 18 is in turn permanently joined to the rear wall of the suds container 10.

A magnetic-field sensor unit 22 that includes one magnetic-field sensor or a plurality thereof is accommodated inside the bearing housing 18 in a central region between the two bearings 20. Besides being arranged as here provided preferably centrally between the two bearings 20, the magnetic-field sensor unit 22 could, of course, conceivably also be arranged closer to one of the two bearings 20. The magnetic field of a magnetized region 24 moved with the drum shaft 14 is detected by the magnetic-field sensor unit 22, with said region in turn being arranged in the region of the magnetic-field sensor unit 22. The drum shaft 14 is in the present exemplary embodiment for that purpose itself made at least in sections of a material having corresponding magnetic or, as the case may be, magnetostrictive properties. The scope of the invention is, though, to be regarded as including the possibility also of employing a drum shaft 14 which, for example, itself possesses no or only insufficient magnetic properties and includes a co-moved component in the form of, for example, a shell that is arranged around the outer circumference and linked to the drum shaft 14 for example frictionally and/or in a form-fit manner. The magnetized region 24 of the drum shaft 14 is preferably formed from a ferromagnetic material having a high magnetostriction constant—for example steel No. 1.4057—so that an inexpensive magnetic-field sensor unit 22 can be employed that exhibits relatively low sensitivity. Owing to the magnetostrictive properties of the magnetized region 24 co-moved with the drum shaft 14 the mechanical deformation of the drum shaft 14 is transformed into a change in the magnetic field formed by the magnetized region 24. Said change in the magnetic field will be registered contactlessly by the magnetic-field sensor unit 22.

Figure 2:
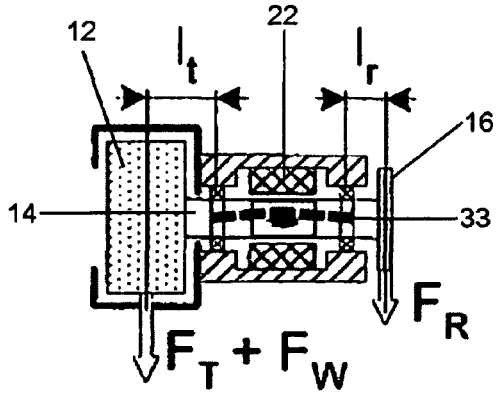
FIG. 2 shows a further schematic sectional view through the machine, embodied as a front-loading washing machine for washing and/or drying laundry, shown in FIG. 1, with the drum shaft's bowing due to the joint gravity-induced weight force of the laundry drum and laundry on the one hand and the belt-tensioning force produced by the driving belt's belt tension on the other being indicated schematically.

Shown schematically in FIG. 2 in a further sectional view through the front-loading washing machine shown in FIG. 1 is the bowing, indicated by the elastic curve 33, of the drum shaft 14. Said bowing is therein caused on the one hand by the bending moment $M_T$ of the jointly acting weight forces $F_T$ of the laundry drum 12 and $F_W$ of the laundry via the lever arm $I_t$ according to the equation $$M_T=(F_T+F_w)*I_t$$

and, on the other, by the bending moment $M_R$ of the belt-tensioning force $F_R$ via the lever arm $I_r$ of the driving belt arranged on the belt pulley 16 according to the equation $$M_R=F_R*I_r.$$

The lines of action of the belt-tensioning force and the weight forces due to the gravitational force have for simplicity's sake been assumed in this example to be parallel. Because the belt-tensioning force $F_R$ of the driving belt, the weight force $F_T$ of the laundry drum, and the lever arms $I_t$ and $I_r$ can be regarded as constant for a device, the bowing of or, as the case may be, bending stress on the drum shaft 14 indicated by the elastic curve 33 is when the washing drum 12 is stationary dependent only on the weight force $F_W$ of the laundry in the laundry drum 12. The direction of said bending stress is constant and independent of the position of the rotational angle of the laundry drum 12.

It is thus possible to precisely determine the weight of the laundry in a simple manner by means of the bowing of or, as the case may be, bending stress on the drum shaft 14 that are indicated by the elastic curve 33. The central arrangement of the magnetic-field sensor unit 22 in the region of maximum loading or, as the case may be, bowing of the drum shaft 14, as well as the—owing to the effect of the inverse magnetostriction correspondingly large—changes in the magnetic field formed by the magnetized region therein enable easy detectability by the magnetic-field sensor unit 22. It is accordingly possible to employ less sensitive and so less expensive magnetic-field sensors, as a result of which the parameter values—torque, torsional moment, flexural force, mass of the laundry, and angle of rotation of the laundry drum 12—of relevance for treating imbalance-induced effects can be registered contactlessly and with no wear-and-tear.

Figure 3:
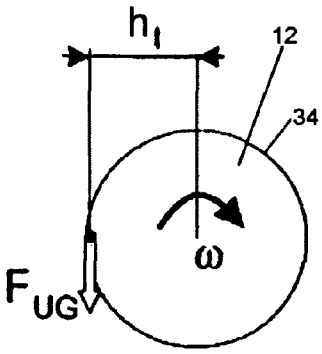
FIG. 3 shows a schematic front view of the laundry drum of the machine for washing and/or drying laundry as shown in FIGS. 1 and 2, with the schematic action of the gravitational force upon a mass that is located on the laundry drum's outer circumference and produced by the laundry's uneven distribution being indicated schematically.

FIG. 3 is a schematic front view of the laundry drum 12 of the machine for washing and/or drying laundry shown in FIGS. 1 and 2. It is explained below how torques that are transferred from the belt pulley 16 to the laundry drum via the drum shaft 14 can be determined:

The driving torque introduced into the drum shaft via the belt pulley 16 is therein opposed by the following torques: Mass moments of inertia occurring when the laundry drum 12 is speeded up or slowed down in its rotational motion, moments of friction due to friction in the bearings 20 and between the laundry drum 12 and the air or, as the case may be, washing liquid surrounding it, and torques changing with the drum's rotation owing to the acceleration of the laundry located on the outer circumference of the laundry drum 12.

The imbalance-induced weight force $F_{UG}$ acting on the outer circumference 34 of the laundry drum 12 rotating at a specific speed is for that purpose shown in FIG. 3. When the laundry drum 12 rotates at a specific speed or, as the case may be, angular velocity $\omega$ exceeding the spreading speed of the laundry, a resulting imbalance can develop owing to an uneven mass distribution having the mass $m_u$. The spreading speed is therein to be understood as the rotational speed at which a centrifugal force acting upon the laundry is equal to or greater than a gravitational force acting thereupon so that the laundry will be immobilized against the laundry drum's inner wall. The mass $m_u$ having the weight force $F_{UG}$ that causes the imbalance must be lifted in the upward movement during one complete revolution of the laundry drum 12 counter to the gravitational force. In the downward course of the revolution of the laundry drum 12 it is conversely accelerated by the gravitational force. The cyclically changing lever arm $h_t$ produces a sinusoidal torque curve $M_{UG}$ on the drum shaft 14 resulting in a torsional stress that changes with the drum shaft's rotational speed or, as the case may be, angular velocity ω and whose amplitude depends on the extent of the resulting imbalance. The to following equation hence applies to the torque curve $M_{UG}$:

$$M_{UG}=F_{UG}*h_t*\sin(\omega t).$$

The position and extent of the imbalance in the washing drum 12 can therefore be precisely determined through evaluating of the loading-relevant characteristic variables that have been determined. The deriving of corresponding control and/or regulating parameters will enable selective intervention in the washing process for reducing or even totally eliminating the imbalance-induced effect.

Figure 4:
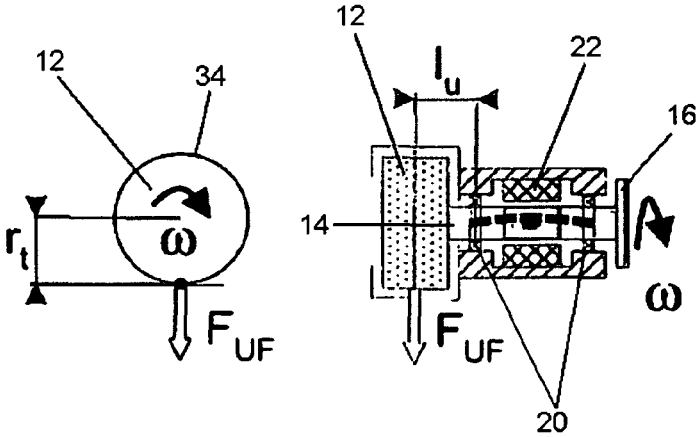
FIG. 4 shows a schematic front view of the laundry drum as well as a schematic sectional view through the machine for washing and/or drying laundry as shown in FIGS. 1 to 3, with the effect of a centrifugal force acting on the laundry drum's outer circumference and produced by an imbalance mass during a dynamic washing process being indicated schematically.

Shown finally in FIG. 4 in a schematic front view of the laundry drum 12 and a schematic sectional view through the machine shown in FIGS. 1 to 3 is a further case of loading the washing machine along with the parameter values or, as the case may be, loading-relevant characteristic variables obtainable therein. What can be determined in particular therein based on a centrifugal force, acting on the outer circumference 34 of the washing drum 12, of the imbalance mass $m_u$ is a bending moment $M_{UF}$. If an imbalance due to an incorrect mass distribution develops during a spin operation at the drum shaft's rotational speed or, as the case may be, angular velocity ω above the laundry's spreading speed it will produce a centrifugal force $F_{UF}$ acting upon the outer circumference 34 (radius $r_t$) of the washing drum 12. Said centrifugal force $F_{UF}$ is obtained from the equation:

$$F_{UF}=m_u*\omega^2*r_t.$$

Said centrifugal force $F_{UF}$ produces via the lever arm $I_u$ a bending moment $M_{UF}$ that in turn gives rise to a bending stress in the drum shaft 14. Because the direction of said stress is constant referred to the magnetized drum shaft 14 but as seen from the outside revolves at the drum shaft's rotational speed or, as the case may be, angular velocity ω, the magnetic-field sensor unit 22 will register a signal that revolves at the drum shaft's rotational speed or, as the case may be, angular velocity ω and depends on the extent of the incorrect mass distribution and its axial location on the outer circumference 34 of the washing drum 12. The bending moment $M_{UF}$ is therein the cause of the actual load on the drum shaft.

Based on the loading-relevant characteristic variables or, as the case may be, imbalance parameters determined by the magnetic-field sensor unit 22 it is possible in an ensuing step of the method to derive control and/or regulating parameters of the machine as a function of the values that have been determined. Said control and/or regulating parameters of the machine are derived by a control device that belongs to the machine and is present in any event but not shown in the figures. For example the rotational speed or, as the case may be, angular velocity of the laundry drum can be changed as a function of the control and/or regulating parameters via the control device, which is linked to the machine's drive, and an imbalance due to an uneven distribution of the laundry thereby avoided or, as the case may be, totally eliminated. It is for that purpose conceivable, for example, to abruptly and where applicable only briefly change the rotational speed or, as the case may be, angular velocity of the laundry drum 12, as a result of which a more even distribution of the laundry can be realized.

The invention claimed is:

1. A method for determining and processing in a washing and/or drying laundry machine, based on a laundry load, a laundry operation characteristic that is one of a loading-relevant characteristic variable and an imbalance of one of a laundry drum and a drum shaft of the machine, the method comprising the following steps:

a) determining the laundry operation characteristic with at least one magnetic-field sensor unit, the magnetic field sensor unit detecting a magnetic field of a magnetized region that is rotated with the one of the laundry drum and the drum shaft; and b) deriving control and/or regulating parameters of the machine as a function of the laundry operation characteristic determined by the magnetic-field sensor unit, wherein the magnetized region is moved radially relative to an at-rest rotational axis of the one of the laundry drum and the drum shaft with which the magnetized region is rotated, the laundry operation characteristic causing the drum shaft to bend which results in the radial movement of the magnetized region.

2. The method as claimed in claim 1, wherein determining the laundry operation characteristic with at least one magnetic-field sensor unit includes determining a torque and/or torsional moment and/or a bending moment and/or at least one flexural force and/or the angular velocity of the drum shaft or the laundry drum.

3. The method as claimed in claim 1, wherein deriving control and/or regulating parameters of the machine includes deriving control and/or regulating parameters by a control device of the machine.

4. The method as claimed in claim 3 and further comprising changing via the control device the angular velocity of the drum shaft or the laundry drum as a function of the control and/or regulating parameters.

5. The method as claimed in claim 1, wherein the magnetic-field sensor unit detects a magnetic field of a magnetized region on the drum shaft.

6. The method as claimed in claim 1, wherein the drum shaft is fabricated at least in sections from a magnetizable material forming the magnetized region.

7. The method as claimed in claim 1, wherein the drum shaft includes a shell part surrounding the drum shaft around its outer circumference, and is made at least in sections of a magnetizable material forming the magnetized region.

8. The method as claimed in claim 1, wherein the one magnetic-field sensor unit determines at least one dynamic parameter value, the at least one dynamic parameter value being a torque and/or torsional moment and/or bending moment being applied to the drum shaft and/or dynamic flexural forces and/or an angular velocity of the drum shaft.

9. The method as claimed in claim 1, wherein the at least one magnetic-field sensor unit is operable to determine at least one static parameter value, the at least one static parameter value being a static flexural force and/or bending moment occurring on the drum shaft.

10. A washing and/or drying laundry machine, comprising:

a drum for receiving laundry;

a drum shaft connected to the laundry drum, the drum shaft for driving the laundry drum;

a bearing arrangement, the bearing arrangement rotatably supporting the drum shaft; and a device for determining, based on a laundry load, a laundry operation characteristic that is one of a loading-relevant characteristic variable and an imbalance of one of the laundry drum and the drum shaft, the device for determining a laundry operation characteristic having a magnetic-field sensor unit, wherein the magnetic-field sensor unit detects a magnetic field of a magnetized region that is rotated with the one of the laundry drum and the drum shaft, and the magnetized region is moved radially relative to an at-rest rotational axis of the one of the laundry drum and the drum shaft with which the magnetized region is rotated, the laundry operation characteristic causing the drum shaft to bend which results in the radial movement of the magnetized region.

11. The machine as claimed in claim 10, wherein the magnetic-field sensor unit detects a magnetic field of a magnetized region on the drum shaft of the laundry drum.

12. The machine as claimed in claim 10, wherein the drum shaft is itself fabricated at least in sections from a magnetizable material forming the magnetized region.

13. The machine as claimed in claim 12, wherein the magnetic-field sensor unit detects a magnetic field of a magnetized region having magnetizable material that is a ferromagnetic steel having magnetostrictive properties.

14. The machine as claimed in claim 10, wherein the drum shaft includes a shell part surrounding the drum shaft around its outer circumference, and is made at least in sections of a magnetizable material forming the magnetized region.

15. The machine as claimed in claim 10, wherein the bearing arrangement includes two bearings between which the at least one magnetic-field sensor unit is arranged.

16. The machine as claimed in claim 10, wherein the at least one magnetic-field sensor unit is connected to a control device of the machine and the control device is operable to set one of a rotational speed and angular velocity of the laundry drum.

17. The machine as claimed in claim 10, wherein the one magnetic-field sensor unit is operable to determine at least one dynamic parameter value, the at least one dynamic parameter value being a torque and/or torsional moment and/or bending moment being applied to the drum shaft and/or dynamic flexural forces and/or an angular velocity of the drum shaft.

18. The machine as claimed in claim 10, wherein the at least one magnetic-field sensor unit is operable to determine at least one static parameter value, the at least one static parameter value being a static flexural force and/or bending moment occurring on the drum shaft.

* * * * *